United States Patent [19]

Patton

[11] Patent Number: 4,892,485

[45] Date of Patent: Jan. 9, 1990

[54] ADAPTER PLATE FOR CONVERTING A THREE PHASE METER SOCKET FOR USE WITH A SINGLE PHASE WATT HOUR METER

[76] Inventor: Victor L. Patton, Grass Valley, Calif.

[21] Appl. No.: 207,543

[22] Filed: Jun. 16, 1988

[51] Int. Cl.[4] ..... H01R 29/00

[52] U.S. Cl. ..... 439/167; 439/517; 29/846

[58] Field of Search ..... 439/174, 166, 167, 171, 439/517, 189, 638, 173; 361/370–375; 29/857, 842, 846, 848

[56] References Cited

U.S. PATENT DOCUMENTS

| | | | |
|---|---|---|---|
| 2,154,411 | 4/1939 | Road et al. | 361/375 |
| 3,904,935 | 9/1925 | Brewer et al. | 439/167 |
| 4,754,368 | 6/1988 | Bullock et al. | 361/372 |

*Primary Examiner*—David Pirlot

*Attorney, Agent, or Firm*—Bernhard Kreten

[57] ABSTRACT

An adapter plate interposed between a single phase meter and a three phase meter outlet to benefit from the more economical operation of a single phase meter when the premises no longer requires the three phase outlet power. The adapter plate includes a sleeve having a barrier and four blades which contact four 120 volt clips operatively connected to 120 volt power at the outlet site. The adpater blades include four clips oriented to receive a single phase meter. Two of the clips are offset from two of the blades to which they are connected so that the single phase meter can be aligned with the three phase outlet socket and thereby accurately monitor power used on the premises. Three legs defining the 200 volt leg wired to the premises are effectively isolated by the adapter.

27 Claims, 2 Drawing Sheets

Figure 1:
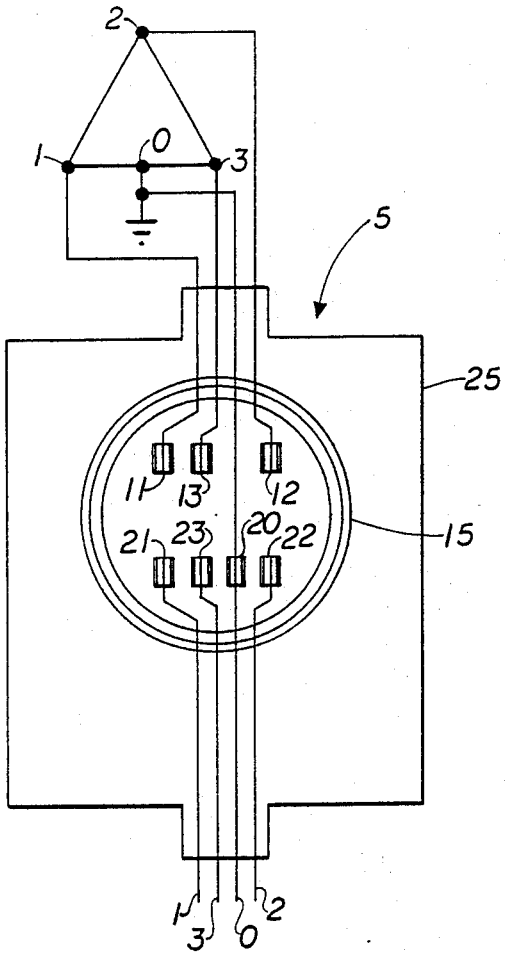

ADAPTER PLATE FOR CONVERTING A THREE PHASE METER SOCKET FOR USE WITH A SINGLE PHASE WATT HOUR METER

FIELD OF THE INVENTION

The following invention relates generally to an adapter plate for converting a three phase meter socket to receive a single phase watt hour meter when the building having a three phase meter is not using any three phase loads.

BACKGROUND OF THE INVENTION

Many customers of electricity, particularly light commercial establishments and residences having central air conditioning, use three phase circuitry wherein one power leg provides 200 volts. It is estimated, however, that approximately 10 percent of all establishments provided with three phase wiring and therefore three phase electrical meters do not actually have any three phase equipment. This occurs for a variety of reasons. For example, a customer may replace the three phase equipment on the premises and therefore no longer require three phase power. In some cases, a change of tenants obviates the need for three phase power supply.

When the need for three phase power no longer exists, two forms of inefficiency arise. With respect to the consumer, he is still paying for electricity on the basis of at least two, factors. The first factor is the consumer's actual use of energy, expressed in kilowatt hours. The second factor is a charge to the consumer with respect to his average "connected load" which reflects the utility company's fixed charges of interest and depreciation on its investment of the equipment necessary to meet the maximum power requirements of that particular customer. Simply stated, the customer is therefore paying for a more expensive three phase meter and a shared cost for a line transformer adjacent to his site of consumption which conditions the voltage and current for expected three phase use. Typically, a consumer will have to bear a monthly minimum meter charge of three dollars ($3.00) for a three phase meter as opposed to one dollar and seventyfive cents ($1.75) for a single phase meter.

With respect to the second form of innefficiency, the utility company must initially absorb the higher equipment costs of the three phase meter and the transformer until the consumer has offset these fees as a function of time. A three phase, 200 amp meter costs approximately $150.00, while its single phase counterpart costs $30.00. In addition, power to a three phase installation requires a special voltage transformer costing $450.00. It is clear that both parties, the consumer and the utility company are engaged in a needless expenditure.

The expenditure that is wasted is further exacerbated by the fact that not only is the three phase meter initially five times more expensive than a single phase meter but it also requires periodic meter tests which are not required for a single phase meter. Meter tests are required on three phase meters within the first year of installation as well as on three phase meters that are over twelve years old.

Conventional wisdom with respect to replacing an unused three phase system with a one phase system includes the belief that a new tenant would be deterred from renting an establishment that does not have three phase capability. Thus, converting a three phase system to a one phase system is not viewed as desireable both by the utility company and by the property owner.

The following patents reflect the state of the art of which applicant is aware insofar as they appear relevant to the instant invention. These patents are included to fulfill the inventor's acknowledged duty to disclose relevant prior art and it is stipulated that these patents have limited relevance to the patentability of the instant invention.

| | | |
|---|---|---|
| 2,805,403 | Road | September 3, 1957 |
| 3,662,323 | Stanback | May 9, 1972 |
| 3,151,924 | Sloop | October 6, 1964 |
| 3,644,872 | Russo, Jr. | February 22, 1972 |
| 4,386,333 | Dillan | May 31, 1983 |
| 4,311,353 | Adlerteg | January 19, 1982 |
| 4,033,658 | Asick | July 5, 1977 |

The patent to Road is informative since he chronicles the evolution of electrical power meters from 1946 and predicts the evolution of the meter to its present state. Thus, he notes that prior to 1956 a simple four terminal meter was prevalent, but that power demands initally led to five terminal meters which will have to be replaced by seven terminal meters to provide four wire service. It would appear that technology has come full circle since the Road patent since the instant invention is directed to a apparatus which converts a seven terminal, four wire service to a four terminal meter.

Sloop is of interest since his purpose is the inverse from that which is the object of the instant invention. Sloop teaches the use of an adapter by which a conventional light weight, single phase socket can be converted into a heavy duty meter socket so that heavy duty conductors can be used without damage thereto.

The remaining citations show the state of the art further.

SUMMARY OF THE INVENTION

By way of contrast, the instant invention is distinguished over the known prior art in that economy can be effected both with respect to the consumer of electricity and the ulitity company. Converting a three phase meter to a single phase meter reduces the consumer's fixed cost, and reduces the number of utility company's outstanding three phase meters and associated three phase power transformers required to service premises that have no need for three phase service.

More particularly, the hard wiring that exists on buildings at the point of communication with a utility's power connection includes an area for receiving an electrical meter. In a three phase installation, this includes seven spring clips which are oriented in a specific fashion. These clips receive seven complimentally oriented blades on a base of the three phase meter. An adapter plate is operatively connects to four of the seven spring clips leaving three of the spring clips idle corresponding to the 200 volt power leg. An opposed face of the adapter exposes four spring clips which connected with the four clips on the building outlet, but the spatial relationship of the adapter clips has been altered so that these four clips can receive four similarly oriented blades on a conventional 120 volt one phase meter.

Thus, the three phase meter and its associated transformer are not required but the system can still be returned to three phase service quickly. Because of the adapter plate according to the present invention, both the three phase equipment and the periodic inspection are no longer needed.

OBJECTS OF THE INVENTION

Accordingly, it is primary object of this invention to provide a new and useful adapter plate which allows a single phase watt hour meter to be plugged into a socket wired for a three phase system.

A further object of this invention is to provide a device as characterized above which is readily retrofitted into existing installations for economy both with respect to the consumer and to the utility company.

A further object contemplates as its objective the provision of a device as characterized above which effectively isolates and causes to remain idle the 200 volt power leg of the three phase circuit while reorienting the 120 volt leg configuration so that it can accomodate a conventional single phase watt hour meter.

A further object of the present invention contemplates providing a device as characterized above which is relatively inexpensive to manufacture, extremely durable in construction and lends itself to mass production techniques.

A further object, when viewed from one vantage Point contemplates providing as adapter plate interposed between a single phase meter and a three phase meter outlet in which a sleeve is provided for coupling the single phase meter to the outlet, the sleeve includes a barrier which precludes direct contact between the outlet and the meter, and a clip-type coupling arrangement to connect the 120 volt legs of the outlet to the meter including a bus bar system which offsets two of the clips as it extends from the socket to align with a conventional single phase meter.

When viewed from another vantage point, it is a further object of this invention to provide a method for adapting a three phase wiring outlet for receiving a single phase watt hour meter which includes isolating a 200 volt power leg on the existing wiring system, offsetting one 120 volt power leg so that it aligns with two terminals on a conventional single phase watt hour meter, and connecting these two offset terminals and a remaining 120 volt power leg to the single phase meter. When this has been accomplished, a line transformer, commonly needed for the three phase system can be omitted.

When viewed from a further vantage point, a further object of this invention is to provide an adapter which replaces a three phase watt hour meter with a single phase conventional meter, so that premises that are wired for but do not require three phase service can benefit from the less expensive phase meter. Four blades extending from an adapter are oriented to be retained in electrical contact with a first set of four spring clips on a power outlet of the premises. A second set of four clips are carried on the adapter in electrical communication with the four blades including two bus bars which space two of the clips so that the four adapter clips can be aligned with four blades on a single phase watt hour meter. In addition, three legs comprising a 200 volt power leg remain isolated.

These and other objects will be made manifest when considering the following detailed specification when taken in conjunction with the appended drawing FIG.

BRIEF DESCRIPTION OF THE DRAWING FIGURES

FIG. 1 - is a schematic representation of the three phase delta system commonly found in premises wired for three phase service.

Figure 2:
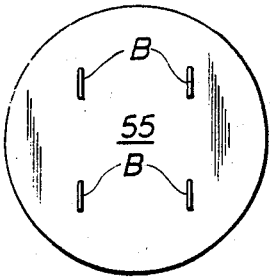

FIG. 2 - is a rear view of a single phase watt hour meter which is to be used with the outlet shown in FIG. 1.

Figure 3:
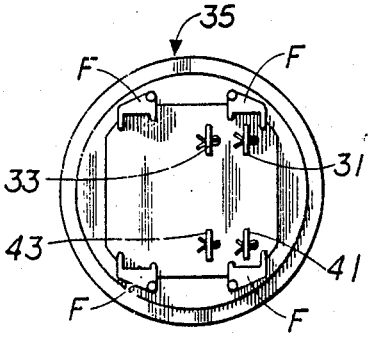

FIG. 3 - is a rear view of the adapter according to the present invention.

Figure 4:
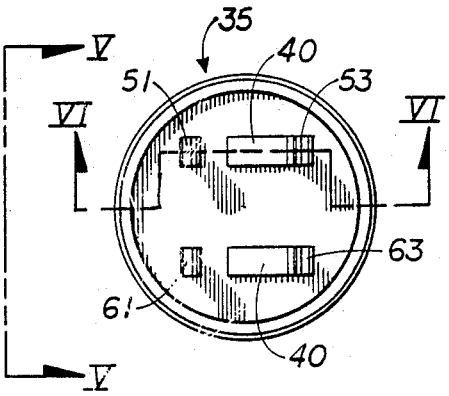

FIG. 4 - is a front view of that which is shown in FIG. 3.

Figure 5:
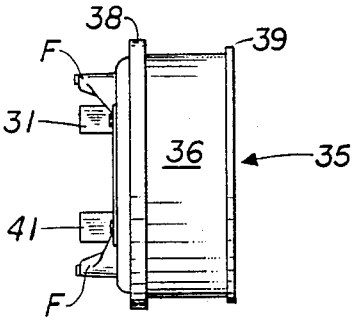

FIG. 5 - is a side view of that which is shown in FIGS. 3 and 4.

Figure 6:
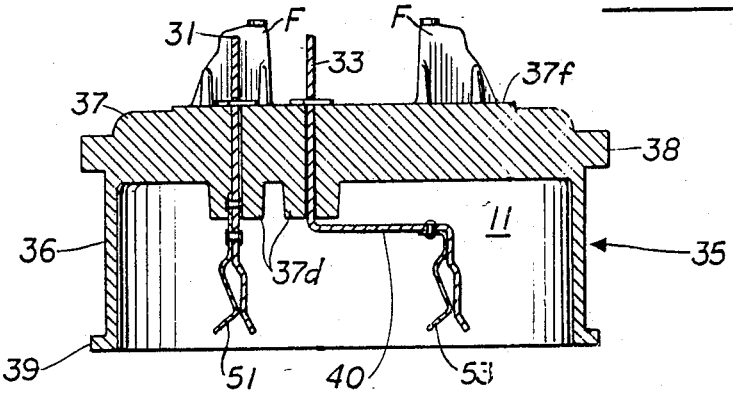

FIG. 6 - is a sectional view taken along lines 6—6 of FIG. 4.

Figure 7:
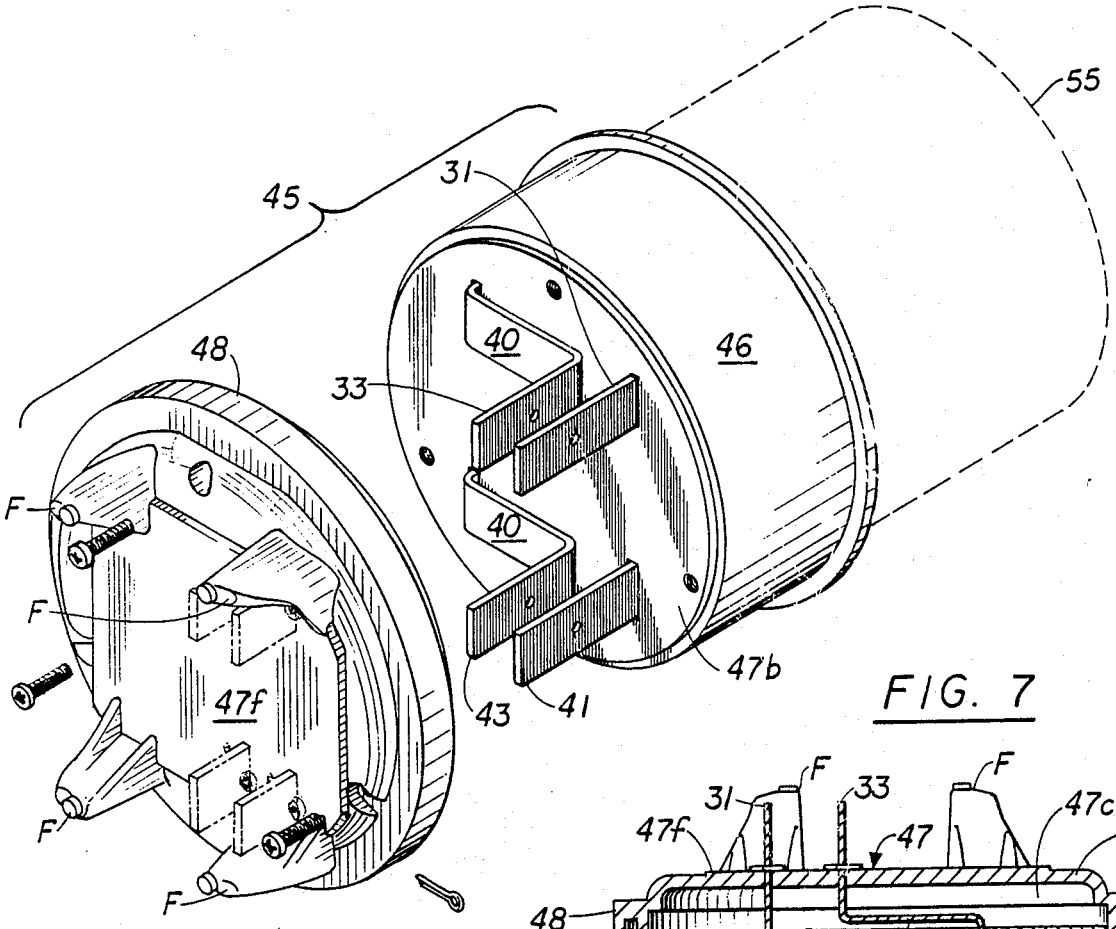

FIG. 7 - is a perspective view of a second form of the invention.

Figure 8:
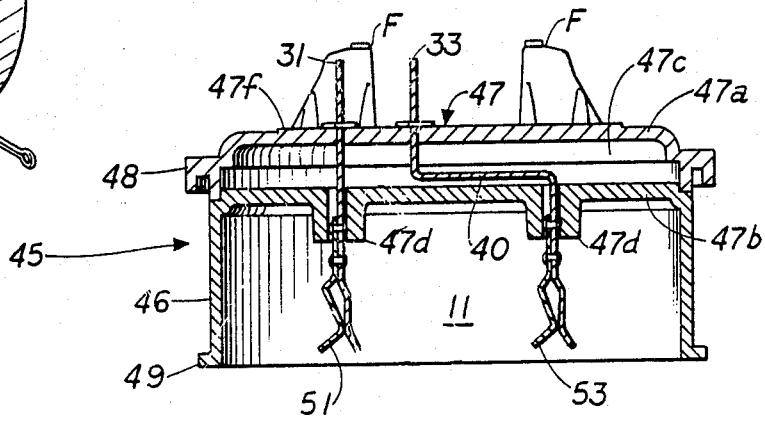

FIG. 8 - is a sectional view taken along lines similar to that in FIG. (i.e. 6—6) depicting a section of the second embodiment.

BRIEF DESCRIPTION OF THE PREFERRED EMBODIMENT

Referring to the drawings now, wherein like reference numerals refer to like parts throughout the various drawing figures, reference numeral 5 is directed to a "Delta" power supply, 15 is directed to a meter socket oriented to receive a three phase meter, 35 and 45 are directed to possible adapters according to the present invention, and 55 is directed to a conventional single phase meter.

More particularly, the Delta 5 includes power legs 1, 2, 3 and a ground 0. Legs 1, 2, and 3 terminate respectively in spring input clips 11, 12, and 13. Spaced from these input clips, output clips 20, 21, 22 and 23 correspond to ground 0 and power legs 1, 2, 3 respectively. All of these "socket" clips are oriented so that a conventional three phase meter can be operatively coupled to the socket input and output clips to give a readout of the power consumed on the premises.

Typically, the three phase meter will be received in a meter socket 15 of substantially circular cross section and placed within an electrical housing 25 shown in FIG. 1.

Assuming the premises associated with this power source has no need for three phase power, the socket input and output clips 12, 22 and ground 20, 0 have no present useful purpose. Accordingly, the adapters 35 or 45 according to the instant invention bypasses these clips and isolate and insulate these clips from any electrical connection.

In addition, the adapter 35 or 45 (FIGS. 6 and 8) alters the spatial relationship between input clips 11, 13 and 21, 23 so that they conform to the equidistant spacing of the blades "B" on a conventional single phase meter 55, whose back surface is shown in FIG. 2.

In order to reorient the spatial relationship between these clips, the adapter 35 or 45 (FIGS. 6 and 8) includes an annular sleeve 36, 46 having a barrier 37, 47 defining a blind bore 11 within which the single phase meter 55 can be slid. Each end of the sleeves 36, 46 includes radially extending flanges 38, 48 and 39, 49 to provide positive abutments both when the adapter is placed in the meter socket 15 and when the single phase meter 55 is placed within the blind bore adjacent barrier 37, 47.

Feet F extend outwardly from an outer face 37*f*, 47*f* of the barrier 37, 47 to contact a rear support wall of the socket 15.

The exposed outer face 37*f*, 47*f* of either barrier 37, 47 includes input blades 31, 33 which communicate within the blind bore 11 of the adapter and terminate in input clips 51, 53 coupled respectively to input blades 31, 33. The spatial relationship of the input clips 51, 53 has been altered with respect to the blades 31, 33 so as to accomodate a single phase meter 55. This is achieved by the use of a bus 40 which laterally offsets input clip 53 with respect to its blade input 33. Power from the utility is therefore monitored by a single phase meter with power return to the premises through output clips 61, 63 returning power to the premises through output blades 41, 43. Note that output clip 63 (FIG. 4) communicates with the output blade 43 via a buss 40, similar to input clip 53 and blade 33. Note that the 200 volt three leg portion of the available power service has not been involved in any way.

The differences shown between the adapter 35 shown in FIG. 6 and the adapter 45 which is shown in FIG. 8 can now be explored. Basically, the barrier 37 and 47 differ from each other in that the barrier 37 is of solid material and the busses 40 laterally offset blades 53, 63 exposed within the blind bore of the adapter 35. In FIG. 8, the barrier 47 includes a pair of spaced parallel walls 47*a* and 47*b* within which a hollow space 47*c* is provided. Space 47*c* is isolated from areas outside the front and rear walls 47*a* and 47*b*. The bus 40 is carried within the hollow 47*c*. Clearly, in another embodiment, 47*c* could be solid material such that the bus 40 is embedded in plastic. Note bosses 37*d*, 47*d* which surround and support portions of the metallic blades as they emerge in the blind bore 11. The bosses provide a stop for the meter.

In use and operation, when it has been determined that the consumer has no need for three phase power, the preexisting three phase meter is first pulled from the socket 15 and placed in storage. The adapter 35 or 45 is inserted into the socket 15 thereby bypassing 200 volt legs 12, 22, and 20 and a conventional single phase meter 55 is placed within the socket of adapter 35, 45 to achieve the attendant purposes.

In view of the forgoing, it should be clear that there has been provided an adapter plate, having one exposed outer extremity provided with blades 31, 33, 41 and 43. These blades are spaced to fit within clips 11, 13, 21 and 23 on a conventional delta outlet used on many premises. A face of the adapter 35 or 45 remote from the blades has spring clips 51, 53, 61 and 63 which are spaced to receive the blades on a conventional single phase watt hour meter shown in FIG. 2. In order to achieve reorientation of clips 53 and 63, a pair of bus bars 40 laterally offset the clips 53, 63 from their connection with blades 33, 43. In both embodiments, the adapter includes a barrier 37, 47 one of which is a solid wall, the other of which is a pair of spaced walls having a hollow in between.

Moreover, having just described the invention is should be apparent that numerous structural modifications and adaptations are contemplated as being a part of this invention as set forth hereinabove and as defined hereinbelow in the claims.

I claim:

1. An adapter plate interposed between a single phase meter and three phase meter socket comprising, in combination:

a sleeve for uniting the single phase meter to the socket having a barrier contained within said sleeve to preclude direct contact between the socket and the meter, a coupling to connect 120 volt clips of the socket to the meter including means for offsetting two of the socket clips to align with the meter, wherein said offsetting means include first and second bus bars for offsetting two of said socket clips with respect to their connection with the three phase meter socket, said bus bars communicating with the socket by means of blades extending from an exterior wall of said barrier, wherein said sleeve has at extremities thereof peripherally extending flanges to serve as abutment stops limiting the amount of orientation required to place said adapter sleeve in the socket, and to limit the placement of the single phase meter within said sleeve.

2. The adapter plate of claim 1 wherein said barrier is a solid piece of cast material and said bus bars extend within a blind bore of said adapter plate.

3. The device of claim 1 wherein said barrier is formed from said first and second spaced walls having a hollow therewithin, said bus bars placed within the hollow.

4. A method of adapting a three phase wiring outlet for receiving a single phase watt-hour meter including the steps of:

isolating a 200 volt power leg on the wiring system with a barrier surrounded by an adapter sleeve including forming said adapter sleeve with peripherally extending flanges to serve as abutment stops limiting the amount of orientation required to place said adapter sleeve in the outlet, and to limit the placement of the single phase meter within said sleeve, offsetting a 120 volt power leg of the wiring system to align with two terminals on the single phase watt-hour meter by connecting first and second bus bars to blades extending from an exterior wall of said barrier, and connecting said two offset terminals and a remaining 120 volt power leg to the single phase meter.

5. The method of claim 4 including forming said barrier as a solid piece of cast material and placing said bus bars within a blind bore of said adapter plate.

6. The method of claim 4 including forming said barrier from said first and second spaced walls having a hollow therewithin, and placing said bus bars within the hollow.

7. An adapter means for replacing a three phase watt-hour meter with a single phase watt-hour meter, from premises which are wired for, but do not require, three phase service comprising in combination:

four blades extending from said adapter means oriented to be frictionally retained in electrical contact with a first set of four spring clips which receives 120 volts on a power outlet of the premises, a second set of four spring clips carried on said adapter means and in electrical communication with said four blades including lateral spacing means between two of said blades and two of said second set of clips to offset said last named clips to allow coupling with blades on the single phase watt-hour meter.

8. The adapter of claim 7 wherein said lateral spacing means include first and second bus bars.

9. The adapter of claim 8 which is circumscribed by a sleeve having peripherally extending flanges to serve as abutment stops limiting the amount of orientation required to place said sleeve in the outlet, and to limit the placement of the single phase meter within said sleeve.

10. The adapter of claim 9 including a sleeve barrier formed as a solid piece of cast material and said bus bars extend within a blind bore of said adapter formed by said barrier and sleeve.

11. The adapter of claim 9 wherein a barrier is formed within said sleeve from first and second spaced walls having a hollow therewithin, said bus bars placed within the hollow.

12. The adapter of claim 11 wherein feet extend from a rear face of said barrier to contact the outlet.

13. The adapter of claim 12 including a sleeve barrier formed as a solid piece of cast material and said bus bars extend within a blind bore of said adapter formed by said barrier and sleeve.

14. The adapter of claim 12 including a boss for supporting said blades as they emerge from said barrier.

15. The adapter of claim 14 including a sleeve barrier formed as a solid piece of cast material and said bus bars extend within a blind bore of said adapter formed by said barrier and sleeve.

16. An adapter plate interposed between a single phase meter and three phase meter socket comprising, in combination:

a sleeve for uniting the single phase meter to the socket having a barrier contained within said sleeve to preclude direct contact between the socket and the meter, a coupling to connect 120 volt clips of the socket to the meter including means for offsetting two of the socket clips to align with the meter, wherein said sleeve has at extremities thereof peripherally extending flanges to serve as abutment stops limiting the amount of orientation required to place said adapter sleeve in the socket, and to limit the placement of the single phase meter within said sleeve.

17. The adapter plate of claim 16 wherein said offsetting means include first and second bus bars for offsetting two of said socket clips with respect to their connection with the three phase meter socket, said bus bars communicating with the socket by means of blades extending from an exterior wall of said barrier.

18. The adapter plate of claim 17 wherein said barrier is a solid piece of cast material and said bus bars extend within a blind bore of said adapter plate.

19. The adapter plate of claim 17 wherein said barrier is formed from said first and second spaced walls having a hollow therewithin, said bus bars placed within the hollow.

20. A method of adapting a three phase wiring outlet for receiving a single phase watt-hour meter including the steps of:

isolating a 200 volt power leg on the wiring system with a barrier surrounded by an adapter sleeve including forming said adapter sleeve with peripherally extending flanges to serve as abutment stops limiting the amount of orientation required to place said adapter sleeve in the outlet, and to limit the placement of the single phase meter within said sleeve, offsetting a 120 volt power leg of the wiring system to align with two terminals on the single phase watt-hour meter and connecting said two offset terminals and a remaining 120 volt power leg to the single phase meter.

21. The method of claim 20 including offsetting the power leg by connecting first and second bus bars to blades extending from an exterior wall of said barrier.

22. The method claim 21 including forming said barrier as a solid piece of cast material and placing said bus bars within a blind bore or said adapter plate.

23. The method of claim 21 including forming said barrier from said first and second spaced walls having a hollow therewithin, and placing said bus bars within the hollow.

24. An adapter plate interposed between a three phase socket having two 120 volt legs and one 200 volt leg and a single phase meter which monitors only the two 120 volt legs, comprising, in combination:

(a) a sleeve having first and second open ends, (b) a barrier in said sleeve which isolates said first end of said sleeve from said second end, and (c) means to offset one 120 volt leg and passing through said barrier such that the two 120 volt legs at said first end are oriented to receive the single phase meter at said second end of said sleeve and electrically couple therewith.

25. A method for converting a building's electrical hookup which is wired for three phase service which has two 120 volt legs and one 200 volt leg to use a standard single phase meter which monitors only the two 120 volt legs, the steps including:

offsetting the one 120 volt leg which is interposed between the two other legs such that the two 120 volt legs now conform to blade spacing on the single phase meter, and isolating the 200 volt leg from the single phase meter by placing a non-conductive barrier between the 200 volt leg and the single phase meter.

26. The method of claim 25 wherein the offsetting is performed by placing a first set of bus bars through the non-conductive barrier, shaping the contour of the first set of bus bars to have two blades at one end which align with the 120 volt leg to beoffset and two clips at an opposite and to align with the single phase meter, and lengthening the remaining 120 volt leg through the barrier using a second set of bus bars which are linear blades at one end and terminate with clip ends in a vertucak plane identical with the clip ends of the first bus bar set.

27. An adapter for a meter socket which converts a 7 jaw, 3 phase meter socket to a single phase, 4 jaw socket, comprising, in combination:

means to isolate a 200 volt power leg from two 120 volt power legs, means to spatially offset the two 120 volt power legs relative to each other and relative to the 200 volt power leg.

whereby said adapter defines a single phase 4 jaw meter socket.

* * * * *